US010582320B2

(12) United States Patent
Wagner et al.

(10) Patent No.: US 10,582,320 B2
(45) Date of Patent: Mar. 3, 2020

(54) CANAL HEARING DEVICE SIZER APPARATUS, SYSTEMS AND METHODS

(71) Applicants: Sonova AG, Stäfa (CH); Paul Wagner, Meilen (CH); Michael Au, Union City, CA (US); Barjinder Chana, San Jose, CA (US); Shilpi Banerjee, Hillsboro, OR (US); Erdal Karamuk, Männedorf (CH)

(72) Inventors: Paul Wagner, Meilen (CH); Michael Au, Union City, CA (US); Barjinder Chana, San Jose, CA (US); Shilpi Banerjee, Hillsboro, OR (US); Erdal Karamuk, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/078,206

(22) PCT Filed: Mar. 10, 2016

(86) PCT No.: PCT/US2016/021845
§ 371 (c)(1),
(2) Date: Aug. 21, 2018

(87) PCT Pub. No.: WO2017/155538
PCT Pub. Date: Sep. 14, 2017

(65) Prior Publication Data
US 2019/0069106 A1 Feb. 28, 2019

(51) Int. Cl.
*H04R 25/00* (2006.01)

(52) U.S. Cl.
CPC ..... *H04R 25/652* (2013.01); *H04R 25/658* (2013.01); *H04R 2225/023* (2013.01)

(58) Field of Classification Search
CPC ..... H04R 25/60; H04R 25/65; H04R 25/652; H04R 2460/17; H04R 2225/77; H04R 2225/023
See application file for complete search history.

(56) References Cited

U.S. PATENT DOCUMENTS 5,701,348 A * 12/1997 Shennib ..... H04R 25/456 381/322
6,359,993 B2 * 3/2002 Brimhall ..... H04R 25/456 381/322
6,367,578 B1 * 4/2002 Shoemaker ..... H04R 25/652 181/135

(Continued)

FOREIGN PATENT DOCUMENTS

WO WO 00/69216 A2 11/2000
WO WO 2009/063096 A2 5/2009

OTHER PUBLICATIONS

PCT Search Report dated Sep. 12, 2016 for PCT App. Ser. No. PCT/US2016/021845.

(Continued)

*Primary Examiner* — Fan S Tsang
*Assistant Examiner* — Ryan Robinson
(74) *Attorney, Agent, or Firm* — Henricks Slavin LLP

(57) ABSTRACT

A hearing device sizer apparatus including a medial sizer, with a medial core portion and a medial seal secured to the medial core portion, and a lateral sizer, with a lateral core portion and a lateral seal secured to the lateral core portion, that are configured to be releasably engaged with one another.

15 Claims, 9 Drawing Sheets

(56) References Cited

U.S. PATENT DOCUMENTS

| | | | | |
|---|---|---|---|---|
| 6,473,513 | B1 * | 10/2002 | Shennib | H04R 25/456 381/322 |
| 6,724,902 | B1 | 4/2004 | Shennib et al. | |
| 7,298,857 | B2 * | 11/2007 | Shennib | H04R 25/602 181/130 |
| 7,580,537 | B2 | 8/2009 | Urso | |
| 7,664,282 | B2 * | 2/2010 | Urso | H04R 25/656 181/135 |
| 8,340,335 | B1 * | 12/2012 | Shennib | H04R 25/60 381/315 |
| 8,467,556 | B2 * | 6/2013 | Shennib | H04R 25/02 381/323 |
| 8,800,712 | B2 * | 8/2014 | Campbell | H04R 25/652 181/135 |
| 9,071,914 | B2 * | 6/2015 | Shennib | H04R 25/02 |
| 9,150,314 | B2 * | 10/2015 | Heath | B65D 73/0042 |
| 9,894,448 | B2 * | 2/2018 | Rasmussen | H04R 25/02 |
| 2018/0367925 | A1 * | 12/2018 | Marcher | H04R 25/652 |

OTHER PUBLICATIONS

Phonak Lyric2 Instruction Booklet for Hearing Care Professionals, 2012.

* cited by examiner

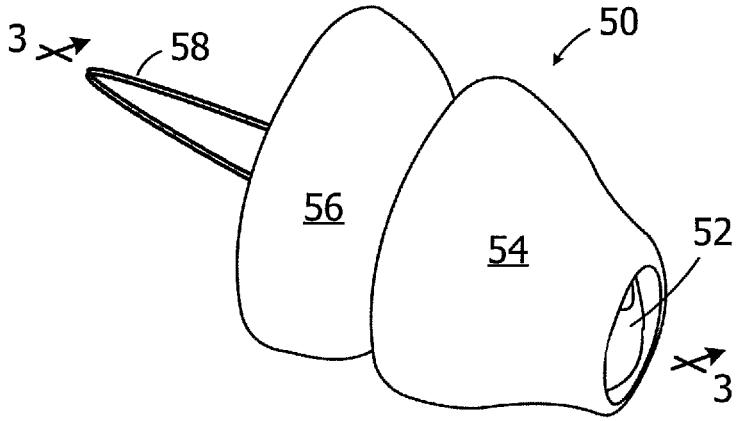
FIG. 2
Prior Art
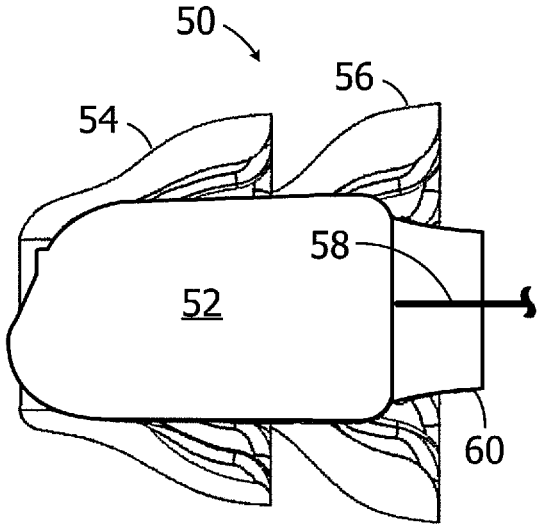
FIG. 3
Prior Art
FIG. 4
Prior Art
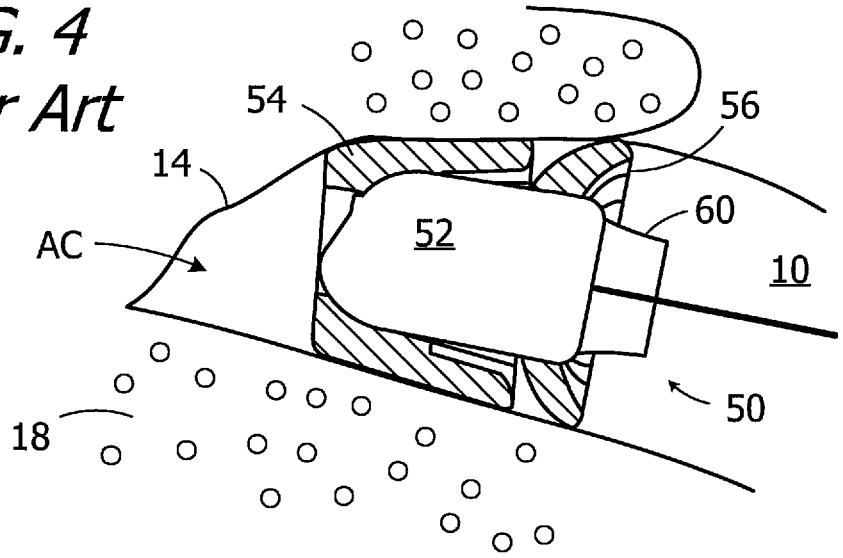

CANAL HEARING DEVICE SIZER APPARATUS, SYSTEMS AND METHODS

CROSS-REFERENCE TO RELATED APPLICATIONS

This application is the U.S. National Stage of PCT App. Ser. No. PCT/US2016/021845, filed Mar. 10, 2016.

BACKGROUND

1. Field

The present inventions relate generally to hearing devices and, for example, hearing devices that are worn entirely in the ear canal for extended periods without daily insertion and removal.

2. Description of the Related Art

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

Extended wear hearing devices are configured to be worn continuously, from several weeks to several months, inside the ear canal. Some extended wear hearing devices are configured to rest entirely within the bony region and, in some instances, within 4 mm of the tympanic membrane. Examples of extended wear hearing devices are disclosed in U.S. Patent Pub. No. 2009/0074220, U.S. Pat. Nos. 7,664,282 and 8,682,016, each of which is incorporated herein by reference. Referring to FIGS. 2 and 3, the exemplary hearing device 50 includes a core 52, a medial and lateral seal retainers (or "seals") 54 and 56, and a removal loop 58. A contamination guard 60 with a screen (not shown) abuts the microphone. The core 52 includes a housing as well as a battery, a microphone, a receiver, and control circuity located within the housing. The seals 54 and 56 suspend and retain the hearing device core 52 within the ear canal and also suppress sound transmission and feedback which can occur when there is acoustic leakage between the receiver and microphone. The seals 54 and 56 are frequently formed from a highly porous and highly compliant foam material (e.g., hydrophilic polyurethane foam), which conforms to the ear canal geometry by deflection and compression, as is illustrated in FIG. 4.

It is especially important that the seals be properly sized for the intended ear canal. An extended wear hearing device with improperly sized seals may result in a less than optimal insertion depth within the ear canal and/or gaps and folds in the seal. Less than optimal insertion depth and/or a poor seal/ear canal interface may result in, for example, discomfort, injury to the ear canal, and inadequate acoustic feedback suppression. One method of evaluating particular hearing device seal sizes involves the use of a sizer, which is a device that includes a non-operative core, which is dimensionally similar to the core of the intended hearing device, with medial and lateral seals secured thereto. The seals are evaluated after the sizer has been inserted into the ear to determine whether or not the proper seal sizes have been selected. The present inventors have determined that sizing processes for extended wear hearing devices are susceptible to improvement. In particular, the present inventors have determined that improper sizing is frequently caused by the clinician's inability to observe the medial portion to the sizer during the sizing process because the lateral portion of the sizer obscures the medial portion.

SUMMARY

A hearing device sizer system in accordance with at least one of the present inventions includes a medial sizer with a medial core portion and a medial seal secured to the medial core portion and a lateral sizer with a lateral core portion and a lateral seal secured to the lateral core portion. The medial sizer and the lateral sizer are configured to be releasably engaged with one another.

A hearing device sizer system in accordance with at least one of the present inventions includes at least first and second medial sizers, each medial sizer having a medial core portion and a medial seal secured to the medial core portion, the medial seal on the first medial sizer being larger than the medial seal on the second medial sizer, and at least first and second lateral sizers, each lateral sizer having a lateral core portion and a lateral seal secured to the lateral core portion, the lateral seal on the first lateral sizer being larger than the lateral seal on the second lateral sizer. The medial sizers and the lateral sizers are configured such that either of the at least first and second medial sizers can be releasably engaged with either of the at least first and second lateral sizers.

A hearing device sizing method in accordance with at least one of the present inventions includes the steps of releasably engaging a medial sizer, having a medial core portion and a medial seal secured to the medial core portion, to a lateral sizer, having a lateral core portion and a lateral seal secured to the lateral core portion, to form a sizer apparatus, and inserting the sizer apparatus into an ear canal such that the medial sizer is in a location adjacent to the tympanic membrane.

The many features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

FIG. 2 is a perspective view of a conventional hearing device.

FIG. 3 is a partial section view taken along line 3-3 in FIG. 2.

FIG. 4 is a partial section view showing the hearing device illustrated in FIGS. 2 and 3 within the ear canal.

DETAILED DESCRIPTION OF EXEMPLARY EMBODIMENTS

Figure 1:
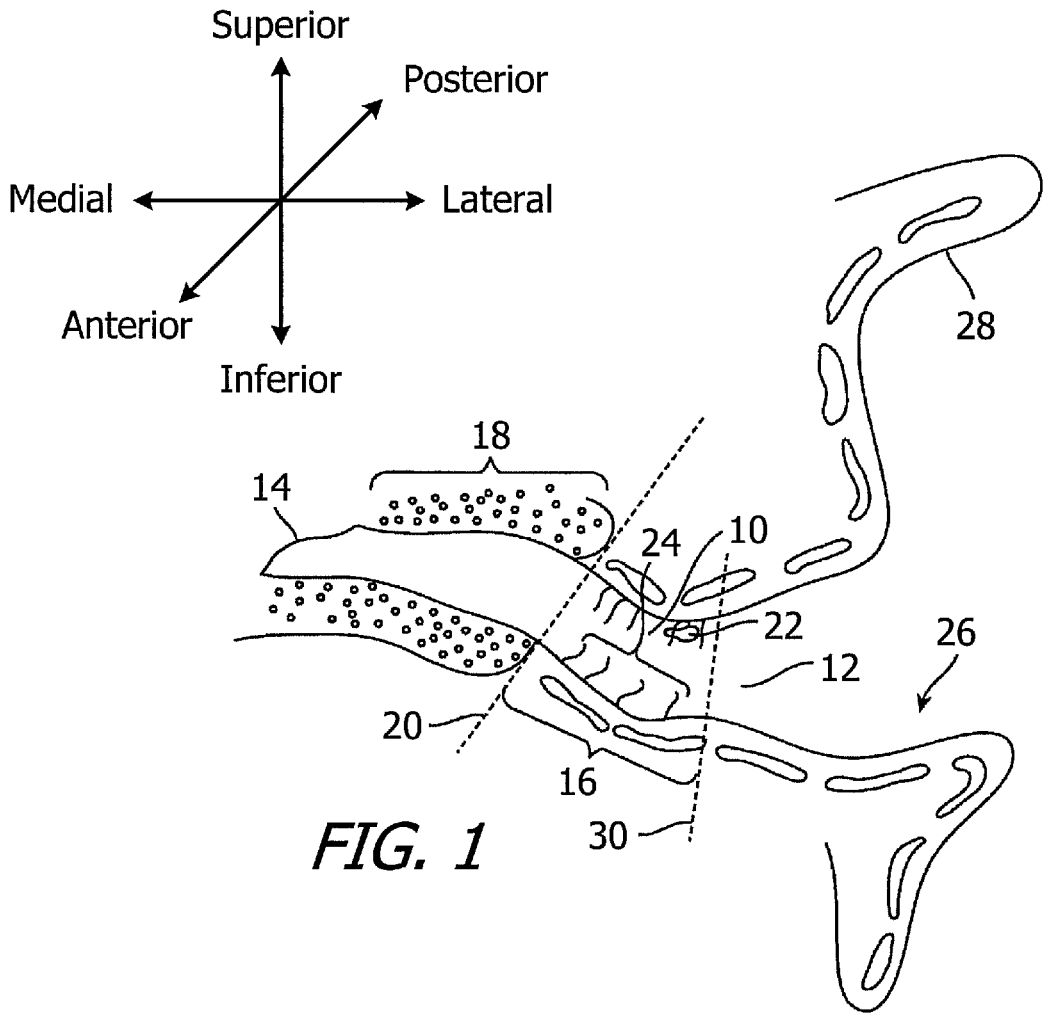
FIG. 1 is a section view showing the anatomical features of the ear and ear canal.

The following is a detailed description of the best presently known modes of carrying out the inventions. This description is not to be taken in a limiting sense, but is made merely for the purpose of illustrating the general principles of the inventions. Referring to FIG. 1, it should also be noted that as used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 5:
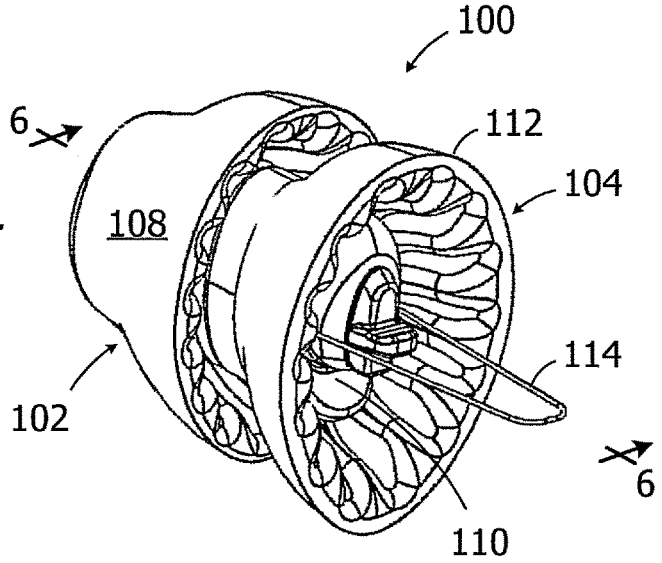
FIG. 5 is a perspective view of a sizer apparatus in accordance with one embodiment of a present invention.
Figure 6:
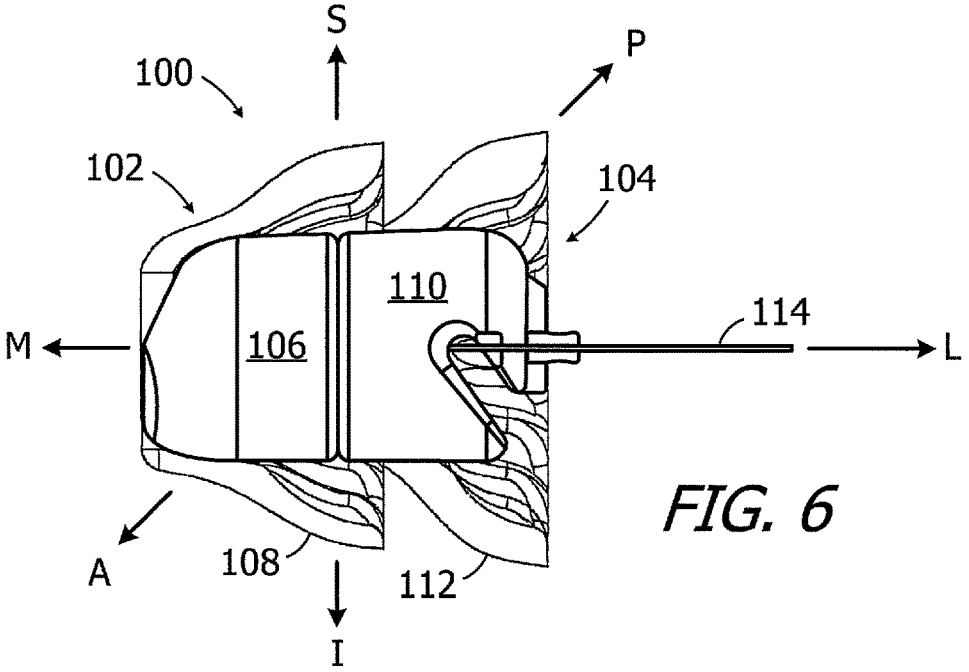
FIG. 6 is a partial section view taken along line 6-6 in FIG. 5.

As illustrated in FIGS. 5 and 6, an exemplary sizer apparatus 100 includes a medial sizer 102 that may be releasably engaged with a lateral sizer 104. The sizer apparatus 100 defines a medial-lateral axis M-L, a superior-inferior axis S-I and a posterior-anterior axis P-A based on the orientation that it will be in when inserted into an ear canal. The medial sizer 102 is releasably engaged with the lateral sizer 104 in the illustrated embodiment in such a manner that the medial and lateral sizers, after being engaged, are permitted to move relative to one another in the medial-lateral direction, and are prevented from moving relative to one another in the anterior-posterior direction and the inferior-superior direction and are also prevented from rotating relative to one another about the medial-lateral axis M-L.

Figure 7:
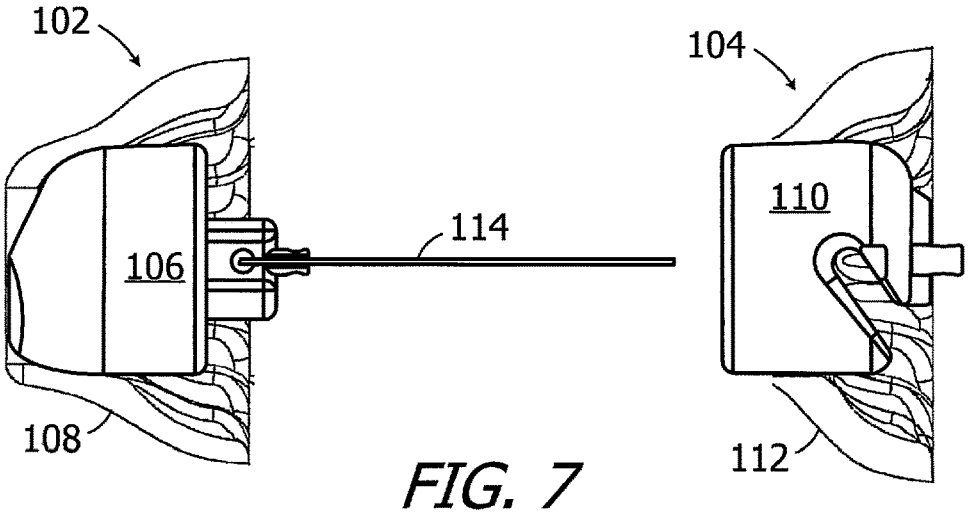
FIG. 7 is a partial section view showing the medial and lateral sizers of the sizer apparatus illustrated in FIG. 5 separated from one another.

The medial sizer 102 includes a medial core portion 106 and a medial seal 108 that is secured to the medial core portion (e.g., with adhesive), and the lateral sizer 104 includes a lateral core portion 110 and a lateral seal 112 that is secured to the lateral core portion (e.g., with adhesive). The medial sizer 102 also includes a removal loop 114 that extends through the lateral sizer 104. The medial core portion 106 may be releasably engaged with the lateral core portion 110 to releasably engage the medial and lateral sizers 102 and 104 with one another and form a sizer apparatus that is similar in size and shape to the extended wear hearing device that is being sized. To that end, the medial and lateral core portions 106 and 110 together define a core that is similar in size and shape to the hearing device core that is the subject of the associated sizing process. The medial and lateral seals 108 and 112 may be the same as those which will be carried on the extended wear hearing device core. As discussed in greater detail below with reference to FIGS. 23 and 24, after the medial and lateral sizers 102 and 104 have been engaged with one another, the sizer apparatus 100 may be inserted into an ear canal in its assembled state. After the effectiveness of the seal formed by the lateral sizer 104 is evaluated, the lateral sizer 104 may be separated from the medial sizer in the manner illustrated in FIG. 7 and removed from the ear canal so the effectiveness of the seal formed by the medial sizer 102 may be evaluated.

There are a variety of advantages associated with the present sizer apparatus. By way of example, but not limitation, after medial and lateral sizers 102 and 104 are assembled into a sizer apparatus 100, the sizer apparatus 100 can be inserted into ear canal and located and compressed within the ear canal in the same manner as the associated extended wear hearing device would be located and compressed within the ear canal. After the lateral seal 112 has been evaluated, the lateral sizer 104 may be removed from the ear canal 10 in such a manner that the medial sizer 102 remains in place. The medial seal 108 may then be evaluated, without obstruction from the lateral seal 112, and the medial sizer 102 thereafter removed from the ear canal. Also, because the seals 102 and 104 are part of a single sizer apparatus 100 that is inserted into the ear canal, the seals 108 and 112 will be positioned, compressed and oriented for evaluation as they would be on an actual extended wear hearing device.

Figure 8:
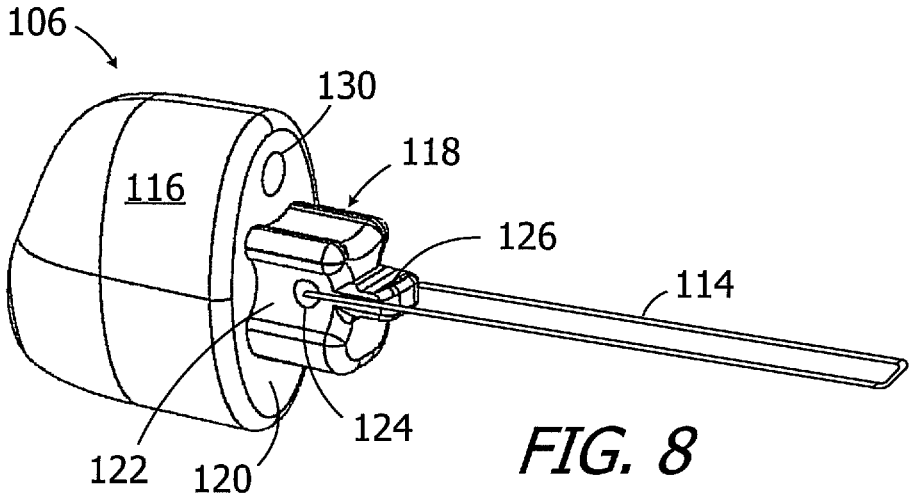
FIG. 8 is a perspective view of the medial core portion of the sizer apparatus illustrated in FIG. 5.
Figure 9:
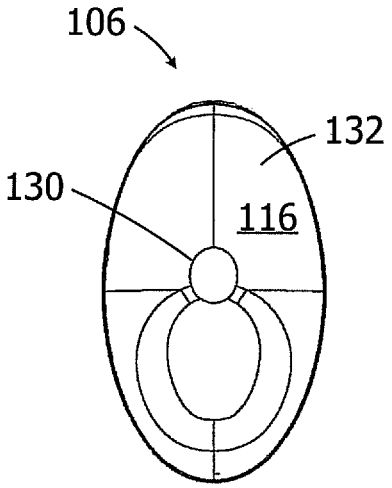
FIG. 9 is an end view of the medial core portion of the sizer apparatus illustrated in FIG. 5.
Figure 10:
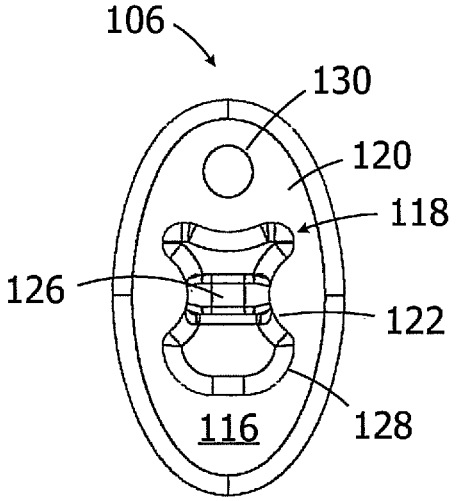
FIG. 10 is another end view of the medial core portion of the sizer apparatus illustrated in FIG. 5.
Figure 11:
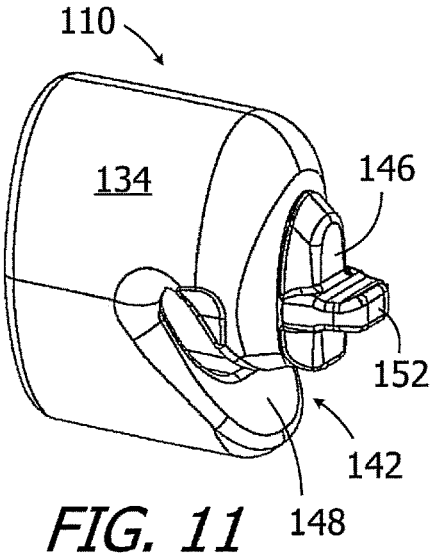
FIG. 11 is a perspective view of the lateral core portion of the sizer apparatus illustrated in FIG. 5.
Figure 12:
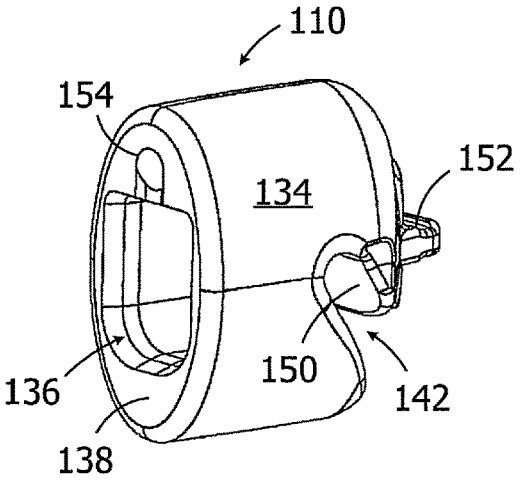
FIG. 12 is another perspective view of the lateral core portion of the sizer apparatus illustrated in FIG. 5.
Figure 13:
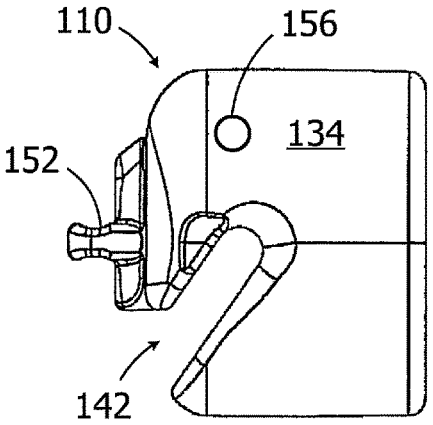
FIG. 13 is a side view of the lateral core portion of the sizer apparatus illustrated in FIG. 5.
Figure 14:
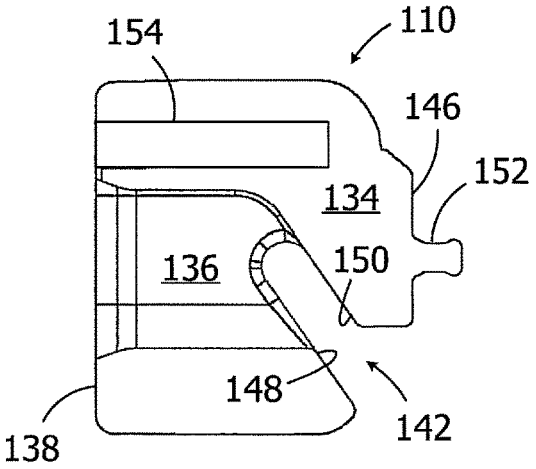
FIG. 14 is a section view taken along line 14-14 in FIG. 16.
Figure 15:
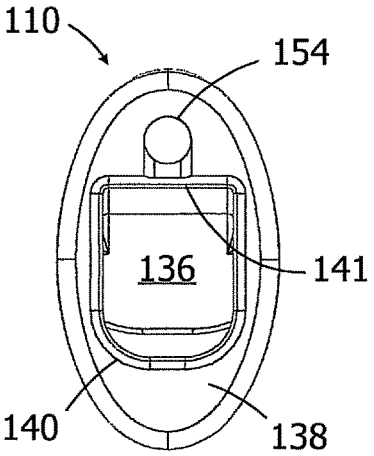
FIG. 15 is an end view of the lateral core portion of the sizer apparatus illustrated in FIG. 5.
Figure 16:
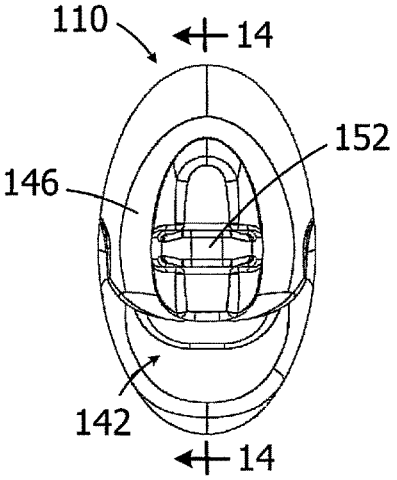
FIG. 16 is another end view of the lateral core portion of the sizer apparatus illustrated in FIG. 5.

Turning to FIG. 8-10, the exemplary medial core portion 106 includes a main body 116 and a projection 118 that extends outwardly from a lateral surface 120. The projection 118 is inserted into a corresponding receptacle 136 (FIGS. 12 and 14) on the lateral core portion 110 when the sizer apparatus 100 is in the assembled state (FIGS. 5 and 6). The locations of the projection and the receptacle may be reversed in other implementations. The projection 118 includes indented side surfaces 122, and an aperture 124 for the removal loop 114 (which may be a loop of suture material), a handle 126, and a curved bottom surface 128. The removal loop 114 may be used to pull the medial sizer 102 out of the ear canal. The handle 126 may be grasped by a forceps (or other tool) and also used to pull the medial sizer 102 out of the ear canal if, for example, the removal loop 114 is not available. The shape of the projection 118 (e.g., the curved bottom surface 128), in combination with the shaped of the receptacle 136 (e.g., the curved bottom surface 140 and the flat top surface 141) in the lateral core portion 110 (FIG. 15) provide the user with a visual clue as to the proper orientation of the medial and lateral sizers 102 and 104 as they are being connected to one another. There is also a clearance fit between the projection 118 and receptacle 136, and the respective shapes and sizes of the projection and receptacle result in a keyed engagement that ensures proper orientation of the medial and lateral sizers 102 and 104 relative to one another by permitting the core portions to move relative to one another in the medial-lateral direction, preventing the core portions from moving relative to one another in the anterior-posterior direction and the inferior-superior direction, and preventing the core portions from rotating relative to one another about the medial-lateral axis M-L. Other arrangements for insuring proper orientation are discussed below with reference to FIGS. 17-21.

The exemplary medial core portion 106 also includes a vent tube 130 that extends from the medial surface 132 to the lateral surface 120. The vent tube may be omitted in other implementations, such as that described below with reference to FIGS. 17-21.

As illustrated in FIGS. 11-16, the exemplary lateral core portion 110 includes a main body 134 and the aforementioned receptacle 136, which extends inwardly from a medial surface 138, that the projection 118 on the medial core portion 106 is inserted into when the sizer apparatus 100 is assembled. The receptacle 136 has a curved bottom surface 140, which is used in conjunction with the curved bottom surface 128 of the projection 118 (FIG. 10) in the manner described above, and a flat surface 141. The lateral core portion 110 also includes a transverse slot 142 that extends through the lateral surface 146 to the receptacle 136, and is defined by lateral internal walls 148 and 150. The removal loop 114 extends laterally through the receptacle 136 and the transverse slot 142 when the sizer apparatus 100 is in the assembled state (FIG. 6). A handle 152, which may be grasped by a forceps (or other tool) and used to pull the lateral sizer 104 out of the ear canal, extends laterally from the lateral surface 146. The exemplary lateral core portion 110 has a vent tube 154 that extends from the medial surface 138 to an outlet tube 156 that extends perpendicularly from the vent tube 154. The vent tube 154 is aligned with the vent tube 130 (FIGS. 8-10) when the sizer apparatus 100 is assembled and the medial core portion lateral surface 120 abuts the lateral core portion medial surface 138. The vent tube 154 and outlet tube 156 may be omitted in other implementations, such as that described below with reference to FIGS. 17-21.

With respect to materials and size, suitable materials for the medial and lateral core portions are rigid materials such as machinable and/or injection moldable plastic (e.g., PEEK, ABS, POM). The medial and lateral core portions 106 and 110 (or 106*a* and 110*a* below) may together have an overall shape and size that is the same as the intending extended wear hearing device. In one exemplary implementation, the medial and lateral core portions 106 and 110 (or 106*a* and 110*a* below) may together have an oval shape, a medial-lateral axis length of about 10-12 mm, an anterior-posterior length of 3.75 mm or less, and an inferior-superior length of 6.35 mm or less. With respect to the clearance fit between the projection 118 and receptacle 136 (or 118*a* and 136*a* below), the receptacle may be about 0 to 25 μm larger than the projection in the anterior-posterior and inferior-superior directions.

The exemplary seals 108 and 112, which support the sizer apparatus 100 within the ear canal bony portion, are the same as those employed on extended wear hearing devices and, accordingly, are configured to substantially conform to the shape of walls of the ear canal, maintain an acoustical seal between a seal surface and the ear canal, and retain the sizer apparatus 100 securely within the ear canal. Additional information concerning the specifics of exemplary seals may be found in U.S. Pat. No. 7,580,537, which is incorporated herein by reference. With respect to materials, the seals 108 and 112 may be formed from compliant material configured to conform to the shape of the ear canal. Suitable materials include elastomeric foams having compliance properties (and dimensions) configured to conform to the shape of the intended portion of the ear canal (e.g., the bony portion) and exert a spring force on the ear canal so as to hold the sizer apparatus 100 in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example.

Figure 17:
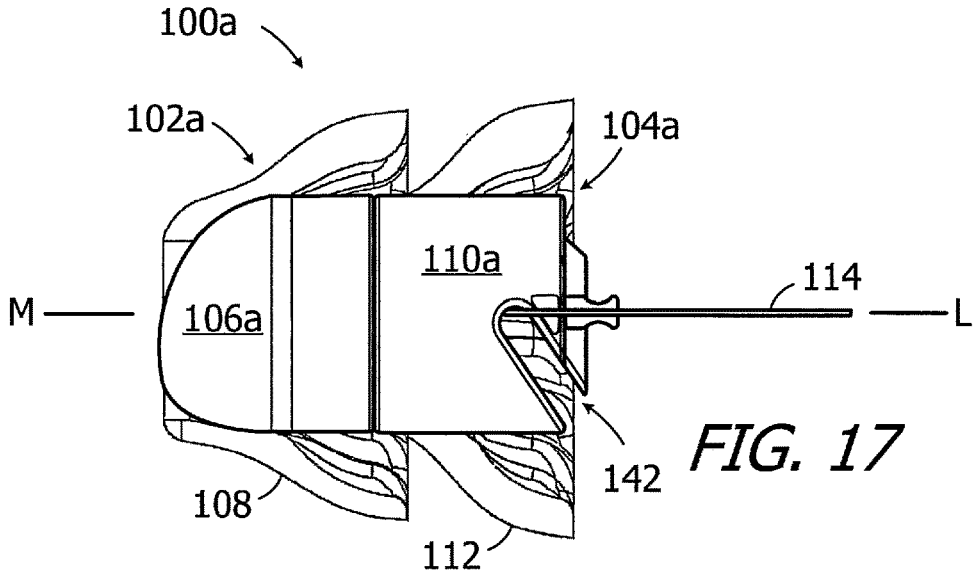
FIG. 17 is a partial section view of a sizer apparatus in accordance with one embodiment of a present invention.

Another exemplary sizer apparatus 100*a* is illustrated in FIG. 17. The sizer apparatus 100*a* is substantially similar to sizer apparatus 100 and similar elements are represented by similar reference numerals. To that end, the sizer apparatus 100*a* includes a medial sizer 102*a* that may be releasably engaged with a lateral sizer 104*a* in such a manner that such a manner that the medial and lateral sizer, after being engaged, are permitted to move relative to one another in the medial-lateral direction, and are prevented from moving relative to one another in the anterior-posterior direction and the inferior-superior direction and are also prevented from rotating relative to one another about the medial-lateral axis M-L. The exemplary medial sizer 102*a* includes a medial core portion 106*a* and a medial seal 108 that is secured to the medial core portion (e.g., with adhesive), and the lateral sizer 104*a* includes a lateral core portion 110*a* and a lateral seal 112 that is secured to the lateral core portion (e.g., with adhesive). The medial sizer 102*a* also includes a removal loop 114 that extends through the lateral sizer 104*a*. Here, however, the vent tubes have been omitted, the projection and receptacle have been reshaped, and an orientation pin has been added.

Figure 18:
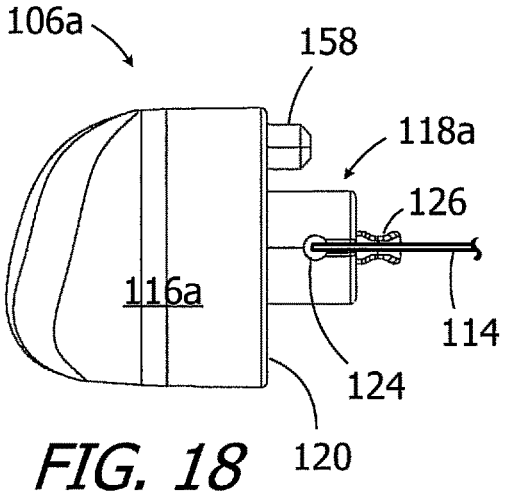
FIG. 18 is a side view of the medial core portion of the sizer apparatus illustrated in FIG. 17.
Figure 19:
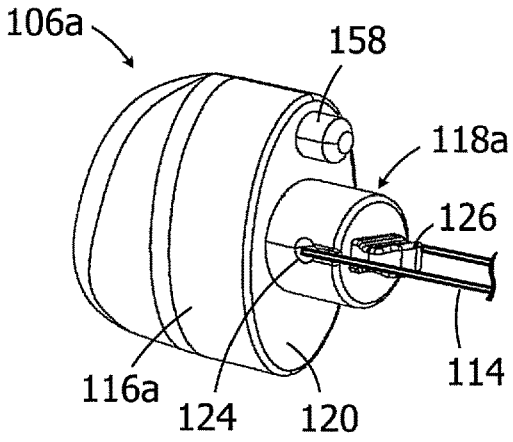
FIG. 19 is a perspective view of the medial core portion of the sizer apparatus illustrated in FIG. 17.

Turning to FIGS. 18 and 19, the exemplary medial core portion 106*a* includes a main body 116*a* and a projection 118*a* that extends outwardly from a lateral surface 120. The projection 118*a*, which is cylindrically-shaped, is inserted into a corresponding cylindrical receptacle 136*a* (FIG. 21) on the lateral core portion 110*a* when the sizer apparatus 100*a* is in the assembled state (FIG. 17). The locations of the projection and the receptacle may be reversed in other implementations. The projection 118*a* includes an aperture 124 for the removal loop 114 and a handle 126. An orientation pin 158, which is inserted into a corresponding receptacle 160 (FIG. 21) on the lateral core portion 110*a* when the sizer apparatus 100*a* is in the assembled state (FIG. 17), extends outwardly from a lateral surface 120. The orientation pin 158 and receptacle 160 insure proper orientation of the medial and lateral sizers 102*a* and 104*a* in the assembled sizer apparatus 100*a*.

Figure 20:
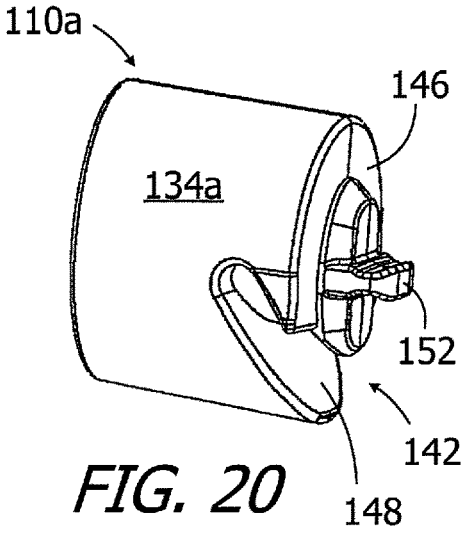
FIG. 20 is a perspective view of the lateral core portion of the sizer apparatus illustrated in FIG. 17.
Figure 21:
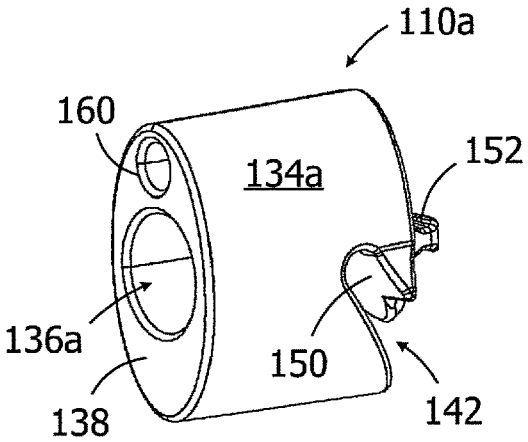
FIG. 21 is another perspective view of the lateral core portion of the sizer apparatus illustrated in FIG. 17.

The exemplary lateral core portion 110*a* illustrated in FIGS. 20 and 21 includes a main body 134*a* and the cylindrical receptacle 136*a*, which extends inwardly from a medial surface 138, for the projection 118*a* on the medial core portion 106*a*. The pin receptacle 160 for the orientation pin 158 also extends inwardly from a medial surface 138. A transverse slot 142 extends through the lateral surface 146 to the receptacle 136*a* and is defined by lateral internal walls 148 and 150. The removal loop 114 extends laterally through the receptacle 136*a* and the transverse slot 142. A handle 152, which may be grasped by a forceps (or other tool) and also used to pull the lateral sizer 104*a* out of the ear canal, extends laterally from the lateral surface 146.

Figure 22:
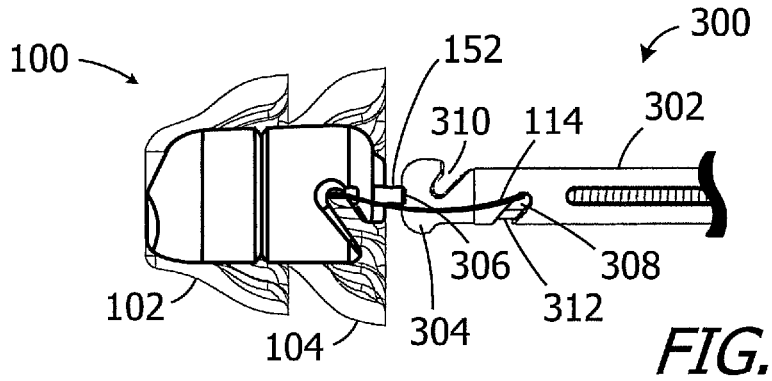
FIG. 22 is a side, partial section view showing a sizer apparatus and a tool that may be used to push in and/or remove the sizer apparatus into the ear canal.

One example of a tool that may be used to push the sizer apparatus 100 (or 100*a*) into the ear canal is the tool 300 illustrated in FIG. 22. The tool 300 includes an elongate shaft 302, a tip 304 with a tip notch 306, a loading notch 308, a removal notch 310, and an internal loading hook 312. During insertion of the sizer apparatus 100 (or 100*a*), the removal loop 114 may be located within the loading notch 308 and the handle 152 on the lateral sizer 104 (or 104*a*) may be located in the tip notch 306. The internal loading hook 312 is movable between the illustrated "locked" position, where it maintains the removal loop 114 within the loading notch 308, and an "unlocked" position where the removal loop can be moved in and out of the loading notch. The tool 300 may also be used to remove the proximal sizer 102 (or 102*a*) from the ear canal in those instances where the lateral sizer 104 (or 104*a*) has already been removed (FIG. 24), or to remove the entire sizer apparatus 100 (or 100*a*), by maneuvering the removal loop 114 into the removal notch 310 and pulling the tool laterally. One commercially available implementation of the tool 300 is the insertion tool for the Lyric3 extended wear hearing aid from Phonak AG.

Figure 23:
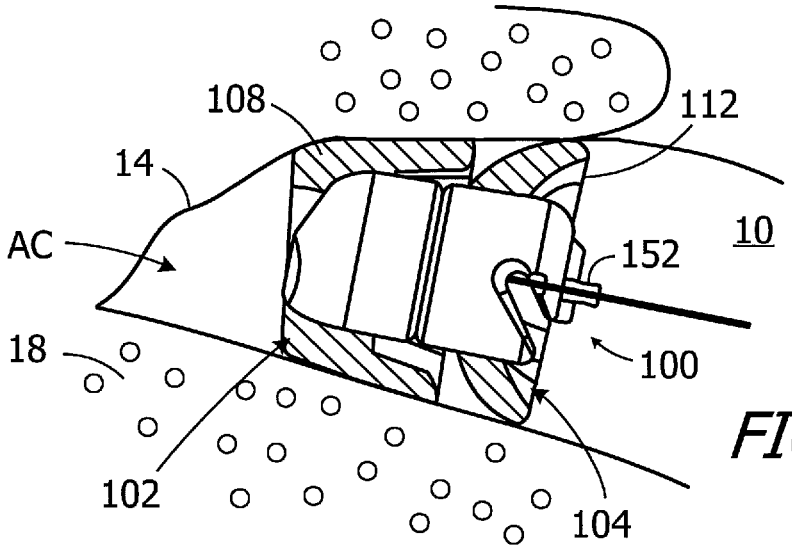
FIG. 23 is a side, partial view of the sizer apparatus illustrated in FIG. 5 within the ear canal.
Figure 24:
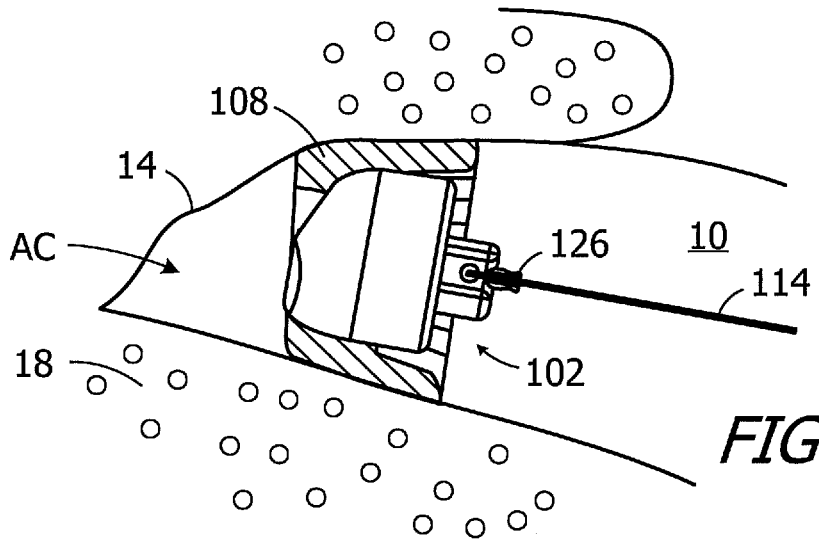
FIG. 24 is a side, partial view of the medial portion of the sizer apparatus illustrated in FIG. 23 after the lateral portion has been removed.

The exemplary sizer apparatus 100 (or 100*a*) may be used to evaluate a combination of seals selected by a clinician in the manner illustrated in FIGS. 23 and 24. After the clinician has determined the depth of the ear canal and has selected medial and lateral sizers 102 and 104 (or 102*a* and 104*a*) having seals 108 and 112 of the desired sizes, the medial and lateral sizers may be assembled into a sizer apparatus 100 (or 100*a*). Alternatively, medial and lateral sizers may be pre-assembled into a sizer apparatus for the clinician's convenience. The sizer apparatus 100 (or 100*a*) may then be inserted into the ear canal 10, as shown in the FIG. 23. The seals 108 and 112 are compressed by the bony region 18 and, in the illustrated embodiment, the medial end of the sizer apparatus 100 (or 100*a*) will be located about 4 mm from the tympanic membrane 14. The sizer apparatus 100 (or 100*a*) is now located and compressed within the ear canal 10 in the same manner as the associated extended wear hearing device would be located and compressed within the ear canal. After the lateral seal 112 has been evaluated to determine whether or not the most effective seal size has been selected, the lateral sizer 104 (or 104*a*) may be removed from the ear canal 10 by, for example, grasping the handle 152 with a forceps (or other tool) and pulling the lateral sizer out of the ear canal. The medial sizer 102 (102*a*) will remain in its original location (about 4 mm from the tympanic membrane 14) because the clearance fit prevents the lateral sizer 104 (or 104*a*) from pulling the medial sizer. The medial seal 108 may then evaluated to determine whether or not the most effective seal size has been selected. The medial sizer 102 (or 102*a*) may then be removed from the ear canal 10 through use of the removal loop 114 or handle 126. If necessary, one or both of the medial and lateral sizers may be replaced with sizers having differently sized seals so that the insertion and evaluation process may be repeated.

As noted above, the size and geometry of the ear canal varies from one person to another and, accordingly, so does the size and geometry of properly sized hearing device seals. The present inventions include a system 400 with a plurality of medial and lateral sizers 102 and 104 (or 102*a* and 104*a*) of various seal sizes. The medial and lateral sizers 102 and 104 (or 102*a* and 104*a*) are stored in packaging 402, which in the illustrated implementation includes a box or other enclosure 404 with a cover 406. The cover may be transparent as shown. Although there are three proximal sizers and three medial sizers in the illustrated implementation (labelled "small," "medium" and "large"), the number of each sizer may be increased or decreased as desired as may the number of sizer sizes. For example, "extra-small," "extra-extra-small," "extra-large" and "extra-extra-large" proximal and medial sizers 102 and 104 (or 102*a* and 104*a*) may be provided. The medial and lateral sizers may also be assembled into a sizer apparatus 100 (or 100*a*) where the medial and lateral sizes are matched (e.g., "small" medial and "small" lateral) or mismatched (e.g., "small" medial and "medium" lateral). By way of example, but not limitation, mismatched sizers may be configured such that the sizer apparatus has an overall conical shape. The conical-shaped sizer apparatus may be used, for example, to determine whether or not the patient has a conical ear canal.

Figure 25:
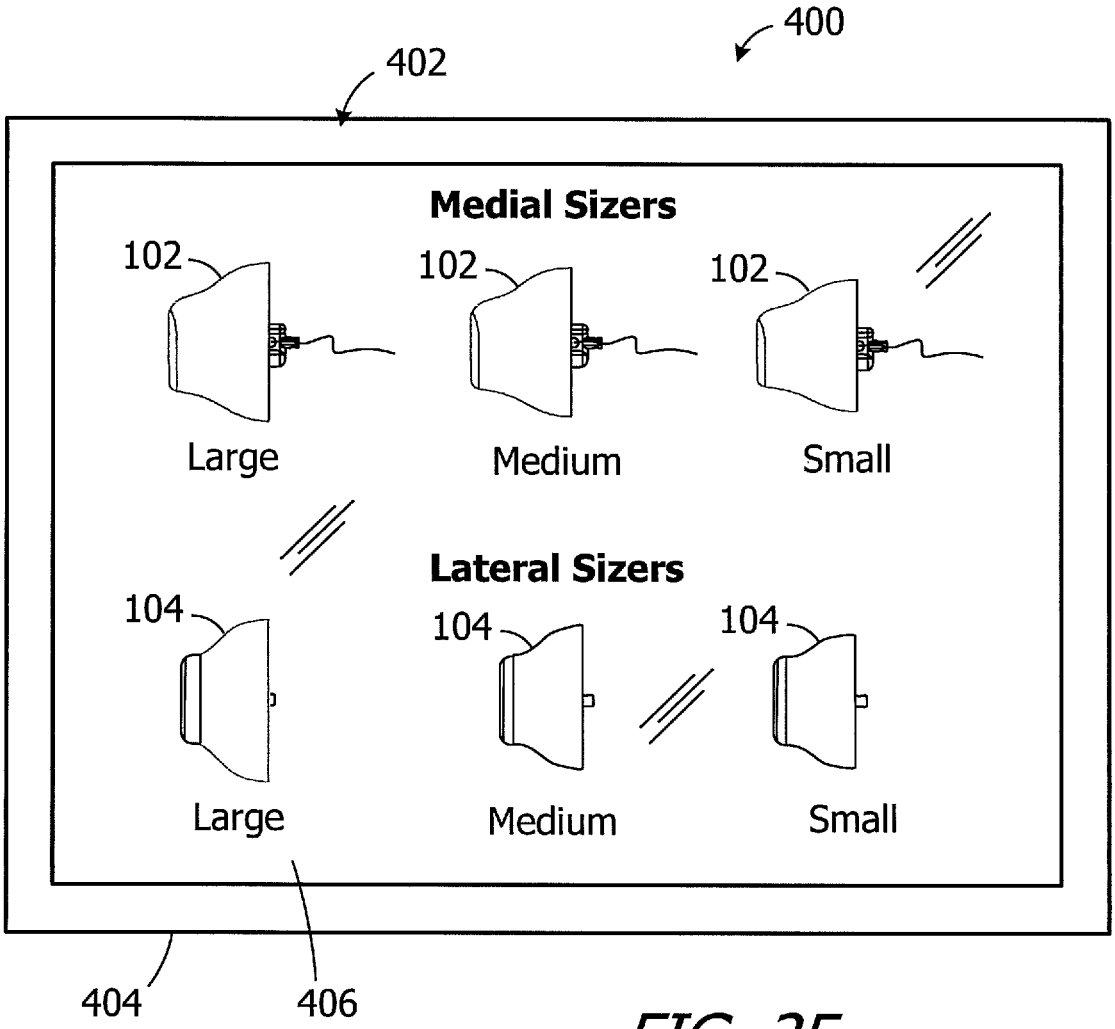
FIG. 25 is a plan view of a sizer apparatus system in accordance with one embodiment of a present invention.
Figure 26:
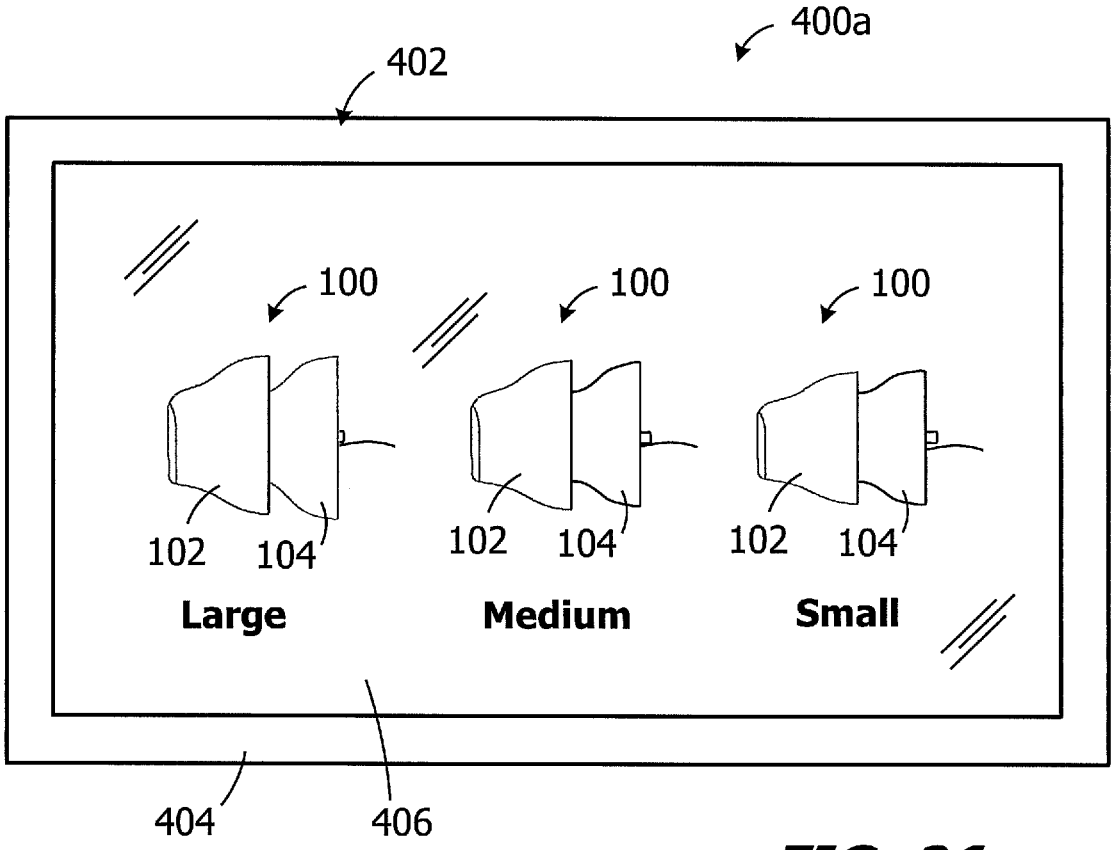
FIG. 26 is a plan view of another sizer apparatus system in accordance with one embodiment of a present invention.

It should also be noted that the medial and lateral sizers 102 and 104 (or 102*a* and 104*a*) may be provided separately (FIG. 25) or as part of pre-assembled sizer apparatus 100 (or 100*a*) as shown in FIG. 26. Here, the exemplary system 400*a* includes one or more of each of a "small," a "medium" and a "large" sizer apparatus 100 (or 100*a*).

It is anticipated that any sizer used during a fitting will be discarded and not used for another patient. As such, the system 400 may be a single-use system with a single one of each medial and lateral sizer size, or may be a multi-use system with a plurality of each medial and lateral sizer size.

Although the inventions disclosed herein have been described in terms of the preferred embodiments above, numerous modifications and/or additions to the above-described preferred embodiments would be readily apparent to one skilled in the art. The inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. A hearing device sizer apparatus, comprising:

a medial sizer including a non-operative medial core portion, a removal loop, and a medial seal secured to the medial core portion; and a lateral sizer including a non-operative lateral core portion and a lateral seal secured to the lateral core portion, wherein the medial sizer and the lateral sizer are configured to be releasably engaged with one another; and the lateral sizer is configured such that the removal loop extends through the lateral sizer when the medial sizer and the lateral sizer are releasably engaged with one another and such that the lateral sizer may be disengaged from the medial sizer without disconnecting the removal loop from the medial sizer.

2. The hearing device sizer apparatus of claim 1, wherein the medial sizer and the lateral sizer are configured to be releasably engaged with one another in such a manner that, when releasbaly engaged, the lateral sizer is laterally movable relative to the medial sizer.

3. A hearing device sizer apparatus, comprising:

a medial sizer including a non-operative medial core portion and a medial seal secured to the medial core portion; and a lateral sizer including a non-operative lateral core portion and a lateral seal secured to the lateral core portion, wherein the medial sizer and the lateral sizer are configured to be releasably engaged with one another;

the medial sizer and the lateral sizer, when releasably engaged, together define a medial-lateral axis, a superior-inferior axis and a posterior-anterior axis; and the medial sizer and the lateral sizer are configured to be releasably engaged with one another in such a manner that, when releasbaly engaged, the medial and lateral sizers are permitted to move relative to one another in the medial-lateral direction, are prevented from moving relative to one another in the anterior-posterior direction, are prevented from moving relative to one another in the inferior-superior direction, and are prevented from rotating relative to one another about the medial-lateral axis.

4. The hearing device sizer apparatus of claim 1, wherein at least one of the medial core portion and the lateral core portion includes a projection; and at least the other of the medial core portion and the lateral core portion includes a receptacle that is configured to receive the projection.

5. The hearing device sizer apparatus of claim 4, wherein the projection defines a cylindrical shape; and the receptacle defines a cylindrical shape.

6. The hearing device sizer apparatus of claim 5, wherein at least one of the medial core portion and the lateral core portion includes an orientation pin; and at least the other of the medial core portion and the lateral core portion includes a receptacle that is configured to receive the orientation pin.

7. The hearing device sizer apparatus of claim 4, wherein the medial sizer and the lateral sizer, when releasably engaged, together define a medial-lateral axis, a superior-inferior axis and a posterior-anterior axis;

the receptacle and the projection are configured to be releasably engaged with one another in such a manner that, when releasbaly engaged, the medial and lateral sizers are permitted to move relative to one another in the medial-lateral direction, are prevented from moving relative to one another in the anterior-posterior direction, are prevented from moving relative to one another in the inferior-superior direction, and are prevented from rotating relative to one another about the medial-lateral axis.

8. A hearing device sizer system, comprising:

at least first and second medial sizers, each medial sizer including a medial core portion and a medial seal secured to the medial core portion, the medial seal on the first medial sizer being larger than the medial seal on the second medial sizer; and at least first and second lateral sizers, each lateral sizer including a lateral core portion and a lateral seal secured to the lateral core portion, the lateral seal on the first lateral sizer being larger than the lateral seal on the second lateral sizer;

wherein the medial sizers and the lateral sizers are configured such that either of the at least first and second medial sizers can be releasably engaged with either of the at least first and second lateral sizers in such a manner that relative movement of the engaged medial and lateral sizers in the inferior-superior direction is prevented.

9. The hearing device sizer system of claim 8, wherein the at least first and second medial sizers and the at least first and second lateral sizers are stored in a same package.

10. The hearing device sizer system of claim 9, wherein the first medial sizer and the first lateral sizer are releasably engaged with one another to form a first sizer apparatus; and the second medial sizer and the second lateral sizer are releasably engaged with one another to form a second sizer apparatus.

11. The hearing device sizer system of claim 8, wherein the core portions of the at least first and second medial sizers comprise non-operative core portions and the at least first and second medial sizers each include a respective removal loops;

the core portions of the at least first and second lateral sizers comprise non-operative core portions; and the at least first and second lateral sizers are configured such that, when one of the at least first and second lateral sizers is releasably engaged with one of the at least first and second medial sizers, the removal loop of the engaged medial sizer will extend through the engaged lateral sizer, such that the engaged lateral sizer may be disengaged from the engaged medial sizer without disconnecting the removal loop from the engaged medial sizer, and such that the engaged lateral sizer is laterally movable relative to the engaged medial sizer.

12. A hearing device sizing method, comprising the steps of:

releasably engaging a medial sizer, including a non-operative medial core portion and a medial seal secured to the non-operative medial core portion, to a lateral sizer, including a non-operative lateral core portion and a lateral seal secured to the non-operative lateral core portion, to form a sizer apparatus;

inserting the sizer apparatus into an ear canal such that the medial sizer is in a location adjacent to the tympanic membrane; and removing the lateral sizer from the ear canal without moving the medial sizer from the location adjacent to the tympanic membrane.

13. The hearing device sizing method of claim 12, further comprising the step of:

removing the medial sizer from the location adjacent to the tympanic membrane and from the ear canal after the lateral sizer has been removed from the ear canal.

14. A hearing device sizing method, comprising the steps of:

releasably engaging a medial sizer, including a medial core portion and a medial seal secured to the medial core portion, to a lateral sizer, including a lateral core portion and a lateral seal secured to the lateral core portion, to form a sizer apparatus;

inserting the sizer apparatus into an ear canal such that the medial sizer is in a location adjacent to the tympanic membrane; and removing the lateral sizer from the ear canal without moving the medial sizer from the location adjacent to the tympanic membrane;

wherein the medial sizer and the lateral sizer, when releasably engaged, together define a medial-lateral axis, a superior-inferior axis and a posterior-anterior axis; and when releasably engaged, the medial and lateral sizers are permitted to move relative to one another in the medial-lateral direction, are prevented from moving relative to one another in the anterior-posterior direction, are prevented from moving relative to one another in the inferior-superior direction, and are prevented from rotating relative to one another about the medial-lateral axis.

15. The hearing device sizer system of claim 8, wherein the medial seal of the first medial sizer is secured to the medial core portion of the first medial sizer with adhesive;

the medial seal of the second medial sizer is secured to the medial core portion of the second medial sizer with adhesive;

the lateral seal of the first lateral sizer is secured to the lateral core portion of the first lateral sizer with adhesive; and the lateral seal of the second lateral sizer is secured to the lateral core portion of the second lateral sizer with adhesive.

* * * * *